US012410551B2

(12) United States Patent
Meyer

(10) Patent No.: US 12,410,551 B2
(45) Date of Patent: Sep. 9, 2025

(54) APPARATUS FOR USE IN CLEANING, DRYING, AND STORING A WETSUIT

(71) Applicant: Pierce Meyer, Wilmington, NC (US)

(72) Inventor: Pierce Meyer, Wilmington, NC (US)

( * ) Notice: Subject to any disclaimer, the term of this patent is extended or adjusted under 35 U.S.C. 154(b) by 729 days.

(21) Appl. No.: 17/862,912

(22) Filed: Jul. 12, 2022

(65) Prior Publication Data

US 2023/0024938 A1 Jan. 26, 2023

Related U.S. Application Data

(60) Provisional application No. 63/224,545, filed on Jul. 22, 2021.

(51) Int. Cl.
*D06F 57/12* (2006.01)
*D06F 57/06* (2006.01)

(52) U.S. Cl.
CPC ..... *D06F 57/12* (2013.01); *D06F 57/06* (2013.01)

(58) Field of Classification Search
CPC ..... D06F 57/00; D06F 57/02; D06F 57/04; D06F 57/08; D06F 57/12; D06F 57/06; B63C 11/02; B63C 2011/023; B63C 2011/046
See application file for complete search history.

(56) References Cited

U.S. PATENT DOCUMENTS 10,337,136 B1 * 7/2019 Fallah ..... A47B 43/00
12,258,197 B2 * 3/2025 Sawyer ..... A47L 23/02
12,303,026 B2 * 5/2025 Hurst ..... A47B 61/06
2008/0222909 A1 * 9/2008 Picozza ..... D06F 58/20 34/195
2017/0071302 A1 * 3/2017 McKelvey ..... A45C 13/103

FOREIGN PATENT DOCUMENTS

KR 20180113012 A * 10/2018 ..... D06F 57/12
SE 336770 B * 7/1971 ..... D06F 57/04
WO WO-2020046095 A1 * 3/2020 ..... D06F 57/08

OTHER PUBLICATIONS

Translation WO-2020046095-A1 (Year: 2020).*
Translation KR-20180113012-A (Year: 2018).*

* cited by examiner

*Primary Examiner* — Jessica Yuen

(74) *Attorney, Agent, or Firm* — Ashley D. Johnson; Dogwood Patent and Trademark Law

(57) ABSTRACT

The invention is directed to an apparatus that allows users to dry, wash, and store their wetsuits and wetsuit accessories. The apparatus includes a receptacle with an interior sized and shaped to hold a wetsuit and a user's accessories. The receptacle comprises a drain configured on one side to dispose of any accumulated water and debris. The interior of the receptacle includes joints that allow a collapsible rack to extend or retract as desired by the user. Thus, a user can wash a wetsuit in the device reservoir, then hang the wetsuit from the drying rack for complete drying. The rack can also be folded to store the wetsuit and any desired accessories (gloves, shoes, etc.) until they are needed.

20 Claims, 15 Drawing Sheets

APPARATUS FOR USE IN CLEANING, DRYING, AND STORING A WETSUIT

CROSS-REFERENCE TO RELATED APPLICATIONS

This application claims priority to U.S. Provisional Patent Application No. 63/224,545, filed Jul. 22, 2021, the entire content of which is hereby incorporated by reference.

TECHNICAL FIELD

The presently disclosed subject matter is generally directed to an apparatus for use in cleaning, drying, and storing a wetsuit and related accessories. The presently disclosed subject matter further relates to methods of making and using the disclosed apparatus.

BACKGROUND

Wetsuits are often used in water sports (e.g., surfing and diving), particularly in cool water or cool weather conditions. The structure of the wetsuit is designed to protect the user from cooler temperatures, as well as from damage to the skin from exposure to sunlight or contact with biological objects (e.g., coral, jellyfish). A conventional wetsuit is typically constructed from a foamed synthetic neoprene layer, covered on both faces by layers of fabric, usually woven or knit from yarns composed of a nylon and lycra blend. After use, the wetsuit should be washed to remove salt water and debris. The fabric layers absorb significant quantities of water, which makes drying the wetsuit a challenging process. It commonly takes up to eight hours or longer for the external fabric layer to dry completely. Many users dry their wetsuits in the sun to accelerate the drying process. However, excessive contact with sunlight can damage the suit due to UV exposure. Alternatively, some users dry wetsuits in conventional dryers. However, exposure of the wetsuit to the extreme temperatures during machine drying can result in serious damage to the wetsuit fabric. Other users commonly hang their wetsuit in the shower for drying, allowing the excess water to travel down the shower drain.

Unfortunately, wetsuits are large and bulky, taking up a great deal of space in the shower. Further, the wetsuit must be moved prior to use of the shower, which can be time consuming and frustrating for users. It would therefore be beneficial to provide an apparatus that can be conveniently and effectively used for cleaning, drying, and storing a wetsuit.

SUMMARY

In some embodiments, the presently disclosed subject matter is directed to an apparatus for cleaning, drying, and storing a wetsuit. Particularly, the apparatus comprises a receptacle defined by a lower face joined to a series of sidewalls, thereby creating an interior and an open top face. The receptacle further includes a plurality of rotatable joints configured on an interior sidewall surface of the receptacle, wherein each joint comprises a central channel and the joint is rotatable from a storage to a use position. Each joint comprises a central channel and the joint is rotatable from a first position where the central channel is horizontal to a second position where the central channel is vertical. The apparatus includes a rack defined by a pair of extendable legs, each leg comprising a first end and a second end, wherein the first end is joined to a central support and the second end cooperates within the joint channel to allow the rack position to be rotated. The apparatus further includes a drain positioned adjacent to the lower face of the receptacle, configured to allow and stop the flow of fluid from the interior of the receptacle.

In some embodiments, the top edge of the receptacle sidewalls includes a peripheral lip configured to releasably join with a lid.

In some embodiments, the receptacle lower face is about horizontal.

In some embodiments, the receptacle lower face is angled towards the drain.

In some embodiments, the receptacle sidewalls are about vertical in orientation.

In some embodiments, the receptacle sidewalls can be at an obtuse or acute angle relative to the lower face.

In some embodiments, the receptacle lower face, sidewalls, or both are collapsible to create a condensed receptacle.

In some embodiments, the receptacle has a rectangular, square, oval, circular, triangular, octagonal, pentagonal, hexagonal, or T-shaped cross-sectional shape.

In some embodiments, the receptacle interior further comprises a spacer positioned between a joint and a receptacle sidewall. In some embodiments, the spacer has a thickness of about 0.1-3 inches.

In some embodiments, the joint is releasably positioned along the interior of the receptacle.

In some embodiments, the joint is permanently positioned along the interior of the receptacle.

In some embodiments, the receptacle comprises a pair of joints positioned on opposing surfaces of the receptacle sidewalls.

In some embodiments, the apparatus further includes a clip positioned adjacent to the joint on an interior surface of the receptacle, wherein the clip is sized and shaped to releasably connect with the rack. The clip comprises a channel that is sized and shaped to releasably connect with the rack.

In some embodiments, the receptacle interior further comprises one or more pouches, containers, netting, or cordage.

In some embodiments, the apparatus further includes one or more fans.

In some embodiments, the drain is a manual drain.

In some embodiments, the drain is configured as a one-way valve, check valve, solenoid valve, butterfly valve, spear valve, gate valve, diaphragm valve, glove valve, or ball valve.

In some embodiments, each rack leg is telescoping, has removable segments, has foldable segments, or combinations thereof.

In some embodiments, wherein each rack leg has a maximum or minimum length of about 1-6 feet.

In some embodiments, the presently disclosed subject matter is directed to a method of cleaning and drying a wetsuit. Specifically, the method comprises washing a wetsuit within the interior of the disclosed apparatus by positioning the wetsuit within the receptacle interior. The method includes rotating the receptacle joint from a storage to a use position relative to the receptacle sidewall. The method comprises extending the legs of the apparatus to a desired length. The method further comprises suspending the washed wetsuit in an upright position on the support bar of the rack to dry, whereby any liquid runoff from the wetsuit is contained within the receptacle interior.

In some embodiments, the method further comprises storing the cleaned and dried wetsuit within the interior of the apparatus receptacle.

In some embodiments, the method further comprises activating the drain to remove the liquid from the interior of the receptacle.

DETAILED DESCRIPTION

Figure 1:
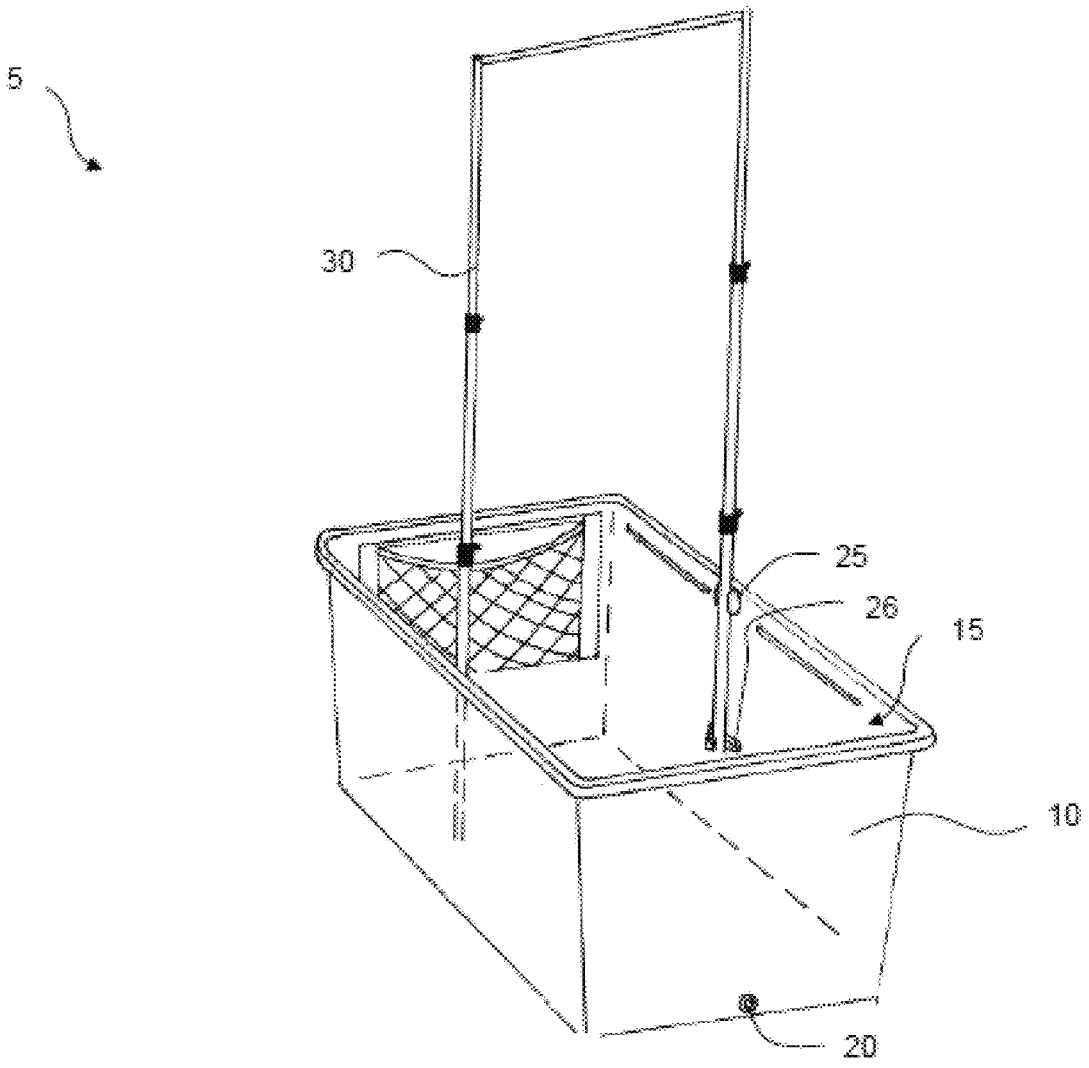
FIG. 1 is a perspective view of a wetsuit washing, drying, and/or storage apparatus in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1° A, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is generally directed to an apparatus that allows users to dry, wash, and store their wetsuits and wetsuit accessories. FIG. 1 illustrates one embodiment of device 5 comprising receptacle 10 that includes interior 15 sized and shaped to hold a wetsuit and a user's accessories. The receptacle comprises drain 20 configured on one side to dispose of any accumulated water and debris. The interior of the receptacle includes joints 25 that allow collapsible rack 30 to extend or retract as desired by the user. Thus, a user can wash the wetsuit in the device reservoir, then hang a wetsuit from the drying rack for complete drying. The rack can also be folded to store the wetsuit and any desired accessories (gloves, shoes, etc.) until they are needed. It should be appreciated that the disclosed apparatus can be used to dry, wash, and store any item and is not limited solely to a wetsuit. For example, raincoats, boots, comforters, and the like can be used with device 5.

Figure 2A:
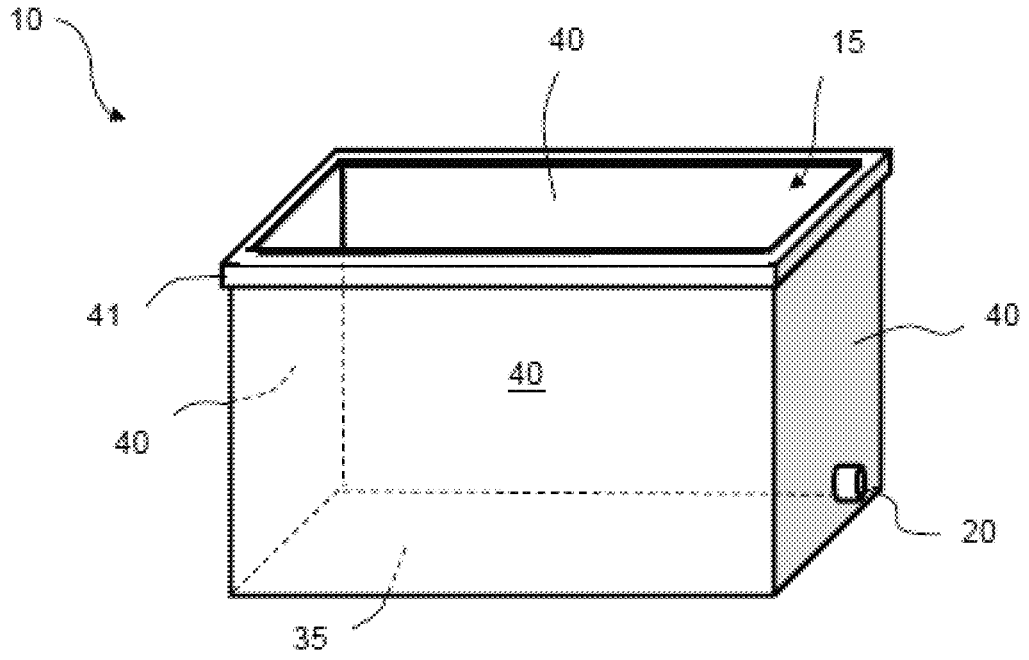
FIG. 2*a* is a perspective view of an apparatus receptacle in accordance with some embodiments of the presently disclosed subject matter.
Figure 2B:
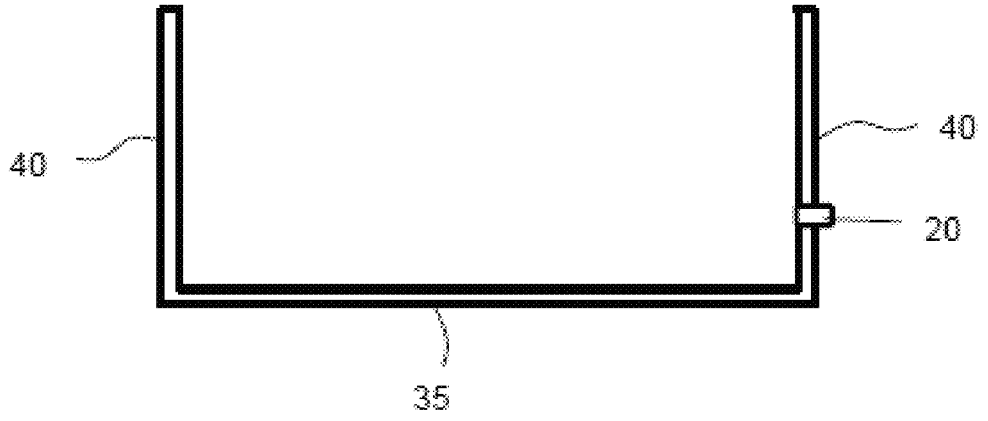
FIG. 2*b* is a cutaway view of an apparatus receptacle in accordance with some embodiments of the presently disclosed subject matter.
Figure 2C:
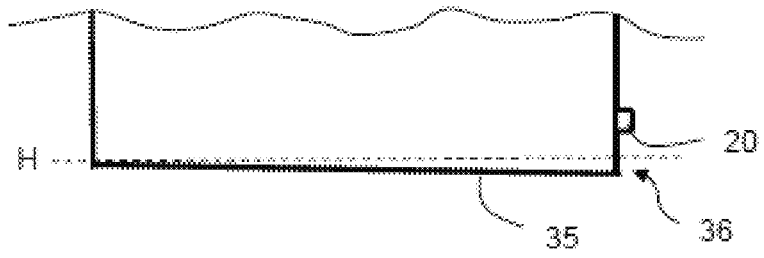
FIG. 2*c* is a fragmentary cutaway view of an apparatus receptacle in accordance with some embodiments of the presently disclosed subject matter.

FIG. 2*a* illustrates one embodiment of receptacle 10 configured to collect fluid during washing and/or run-off of liquid from a wetsuit. The receptacle comprises lower face 35 that rests on a support surface, such as the ground or the bottom of a shower. The lower face is attached to a series of sidewalls 40 to create wetsuit-receiving interior 15. The interior can be water tight to prevent leaks. In some embodiments, the lower face is configured to be about horizontal, allowing the receptacle to evenly rest on a level support surface, as shown in FIG. 2*b*. However, the presently disclosed subject matter is not limited and lower face 35 can be slightly angled towards drain 20 to facilitate drainage of fluid from the interior of the receptacle, as shown in FIG. 2*c*. In some embodiments, the lower face can include angle 36 of about 1-30 degrees relative to the horizontal (H).

Figure 2D:
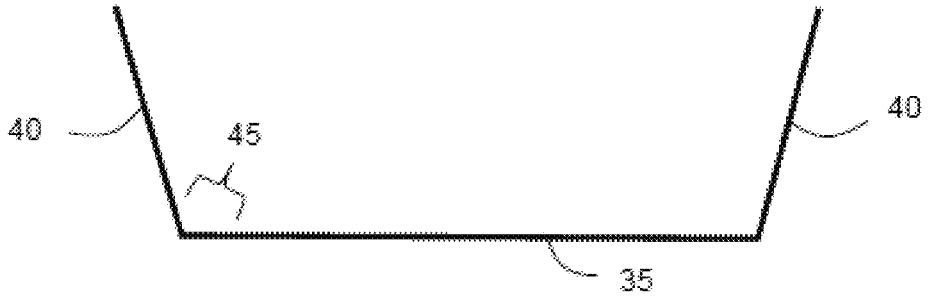
FIG. 2*d* is a cutaway view of an apparatus receptacle comprising obtusely angled sidewalls in accordance with some embodiments of the presently disclosed subject matter.
Figure 2E:
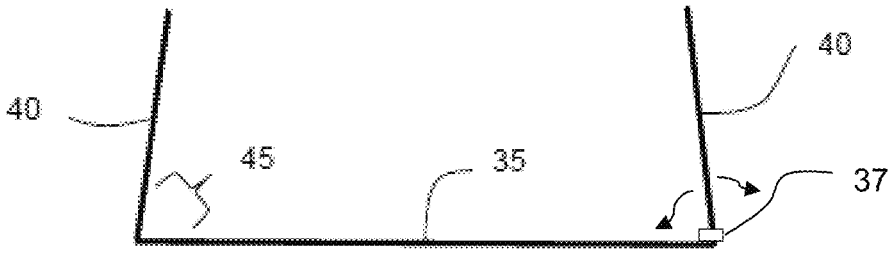
FIG. 2*e* is a cutaway view of an apparatus receptacle comprising acutely angled sidewalls in accordance with some embodiments of the presently disclosed subject matter.

Sidewalls 40 can be about vertical in orientation (e.g., at an approximate right angle relative to lower face 35), as illustrated in FIG. 2*a*. However, the presently disclosed subject matter is not limited and angle 45 between the sidewalls and lower face 35 can be obtuse or acute, as shown in FIGS. 2*d* and 2*e*, respectively. When the sidewalls are configured at an obtuse angle, it allows for additional runoff from the wetsuit to be caught and transported into the interior of the device. When the sidewalls are at an acute angle, it would be advantageous to securely retain the products within the device interior during storage (e.g., the lid is less likely to become dislodged). In some embodiments, each sidewall can include about the same angle relative to vertical. In other embodiments, angle 45 of at least one sidewall differs from at least one other sidewall with regard to angle 45.

In some embodiments, sidewalls 40 can be collapsible to create a condensed structure. The term "collapsible" refers to a material or design that can fold down into a more compact shape. Thus, sidewalls 40 and/or lower face 35 can include one or more flexible hinges 37 that allow the length of the sidewalls to be folded. Thus, the sidewalls can fold to be parallel with and/or contact lower face 35 during storage.

Figure 3:
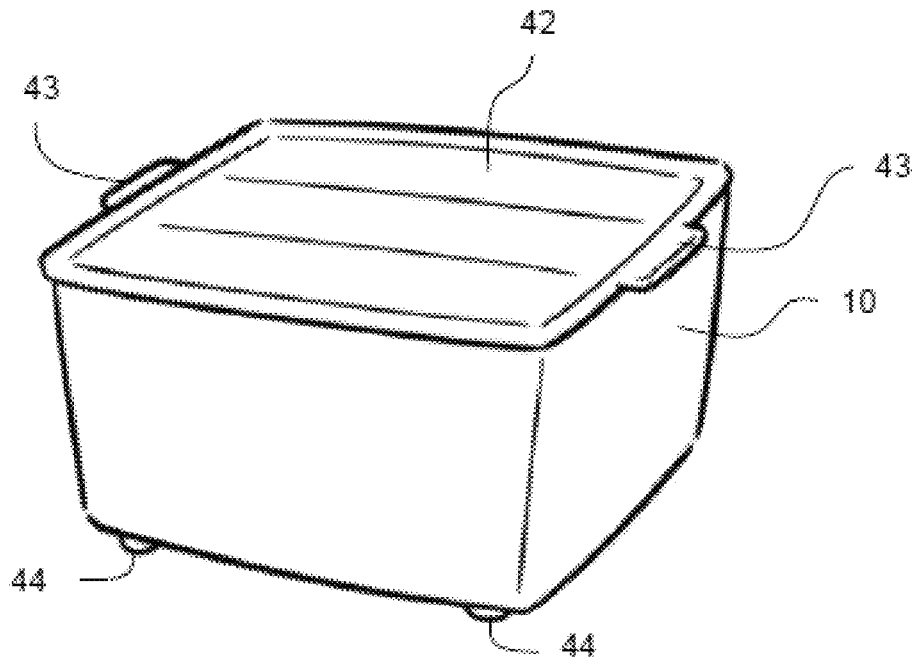
FIG. 3 is a perspective view of an apparatus and a corresponding lid in accordance with some embodiments of the presently disclosed subject matter.

The top edge of sidewalls 40 can include lip 41 that can be used to secure lid 42 to the receptacle top edge, as shown in FIG. 3. The lid can create a closed interior to the receptacle, protecting the internal contents from theft, damage, exposure to the sun, and the like. In some embodiments, lid 42 can include one or more optional handles 43 that facilitate positioning and/or removal of the lid from the top surface of the receptacle. In some embodiments, the lid can provide a surface upon which the user can stand while changing into or out of their wetsuit. However, the lid is optional and receptacle 10 can be configured without a lip and/or lid.

The receptacle can further optionally include one or more feet 44 adjacent to bottom face 35. The term "foot" broadly refers to any element that elevates the receptacle a desired distance from a support surface. Feet 44 can be useful in situations where a user wishes to keep the device raised (e.g., when the ground is sandy, muddy, wet, or dirty). The feet can be permanently installed on bottom face 35 (e.g., through the use of welding, adhesive, and the like) or removably attached to allow the user to customize the receptacle as needed.

Figure 4:
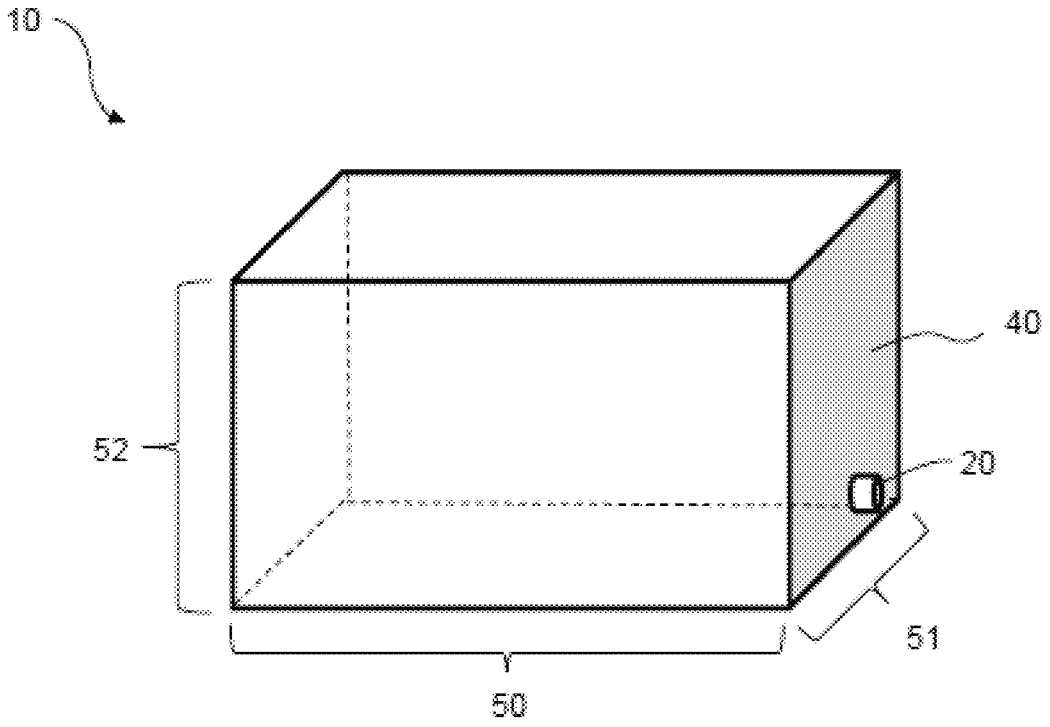
FIG. 4 is a perspective view of an apparatus receptacle in accordance with some embodiments of the presently disclosed subject matter.

Receptacle 10 can be configured in any desired size. For example, the receptacle can include length 50 and/or width 51 of about 15-40 inches (at least/no more than about 15, 20, 25, 30, 35, or 40 inches), as shown in FIG. 4. The term "length" refers to the longest horizontal distance of the receptacle. The term "width" refers to the longest horizontal distance perpendicular to the length. The receptacle can have height 52 of about 10-30 inches (e.g., at least/no more than about 10, 15, 20, 25, or 30 inches). The term "height" refers to the longest vertical distance of the receptacle. It should be appreciated that the receptacle dimensions are not limited and can be configured greater or less than the length, width, and height ranges given herein.

Receptacle 10 can have any desired cross-sectional shape, such as (but not limited to) rectangular, square, oval, circular, triangular, octagonal, pentagonal, hexagonal, T-shaped, abstract, and the like.

The receptacle can be constructed from any desired material, such as (but not limited to) plastic, metal, wood, or combinations thereof. For example, in some embodiments, the receptacle can be constructed from waterproof materials and/or durable materials that resist damage from salt water, sand, and the like.

Figure 5A:
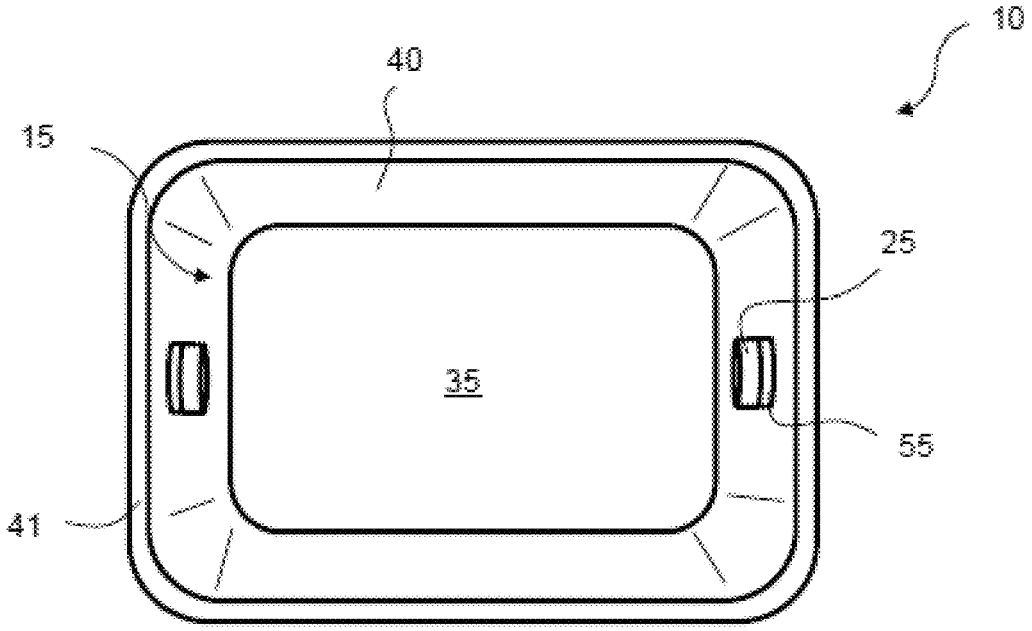
FIG. 5*a* is a top plan view of an apparatus receptacle comprising a plurality of spacers and joints in accordance with some embodiments of the presently disclosed subject matter.

As set forth above, receptacle 10 includes interior 15 sized and shaped to house a wetsuit, along with the user's accessories (e.g., wallet, gloves, sunglasses). FIG. 5*a* illustrates one embodiment of interior 15 comprising at least two joints 25. The joints are configured to hold rack 30 in an extended or folded position. To this end, each joint can include spacer 55 to provide spacing from the interior sidewall of the receptacle, allowing enough clearance for the rack to extend in an upward direction.

Figure 5B:
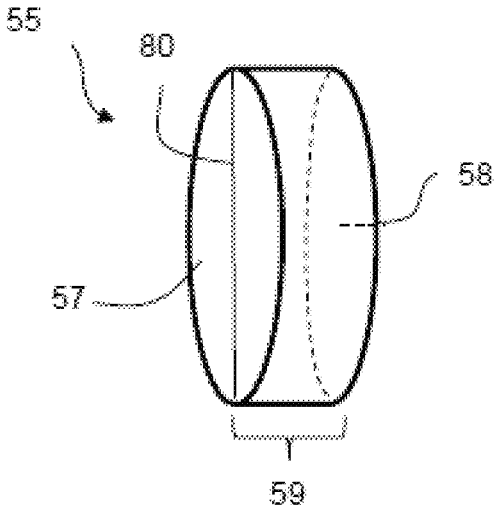
FIG. 5*b* is a perspective view of an apparatus spacer in accordance with some embodiments of the presently disclosed subject matter.

FIG. 5*b* illustrates one embodiment of spacer 55 that cooperates with the joint. The spacer includes front face 57 and opposed rear face 58. The spacer further includes thickness 59, which can be varied depending on the desired distance from a receptacle sidewall. The term "spacer thickness" refers to the longest horizontal distance between the front and rear faces of the spacer. In some embodiments, thickness 59 can be about 0.1-3 inches (e.g., at least/no more than about 0.1, 0.25, 0.5, 0.75, 1, 1.25, 1.5, 1.75, 2, 2.25, 2.5, 2.75, or 3 inches). Similarly, the spacer can have diameter 80 of about 2-5 inches (e.g., at least/no more than about 2, 2.25, 2.5, 2.75, 3, 3.25, 3.5, 3.75, 4, 4.25, 4.5, 4.75, or 5 inches). The term "diameter" refers to the longest straight-line distance that passes through the top face of the spacer. However, thickness 59 and diameter 80 are not limited to the ranges given herein.

Figure 5C:
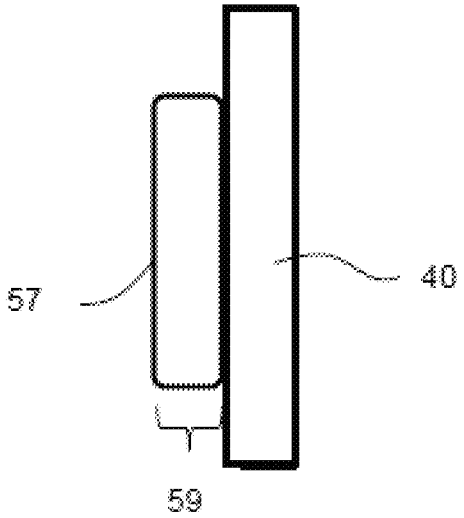
FIG. 5*c* is a side plan view of an apparatus spacer positioned on an interior receptacle wall in accordance with some embodiments of the presently disclosed subject matter.

As shown in FIG. 5*c*, the spacer attaches to the interior surface of sidewall 40 using any desired mechanism, such as (but not limited to) the use of adhesives, magnets, welding, clasps, fasteners, snap-fit closure, pressure-fit closure, and the like. In some embodiments, the spacer can be removably positioned at any desired location on a sidewall of the receptacle. In other embodiments, the spacer is permanently attached to receptacle sidewall 40.

Figure 6A:
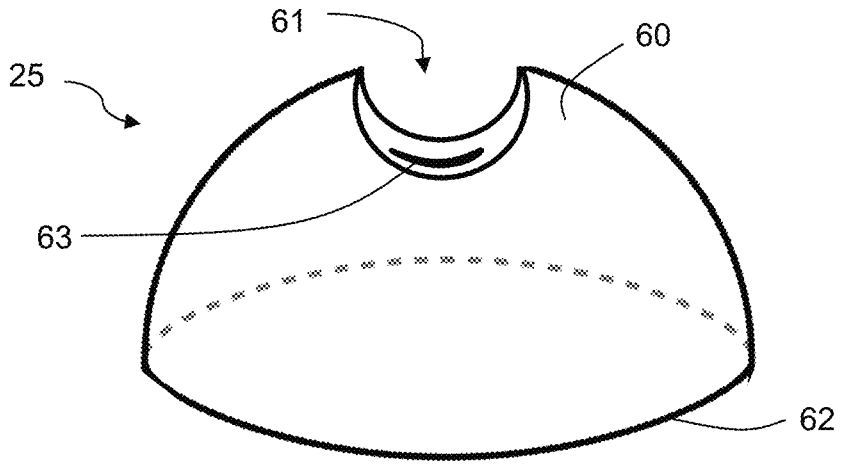
FIG. 6*a* is a perspective view of an apparatus joint in accordance with some embodiments of the presently disclosed subject matter.
Figure 6B:
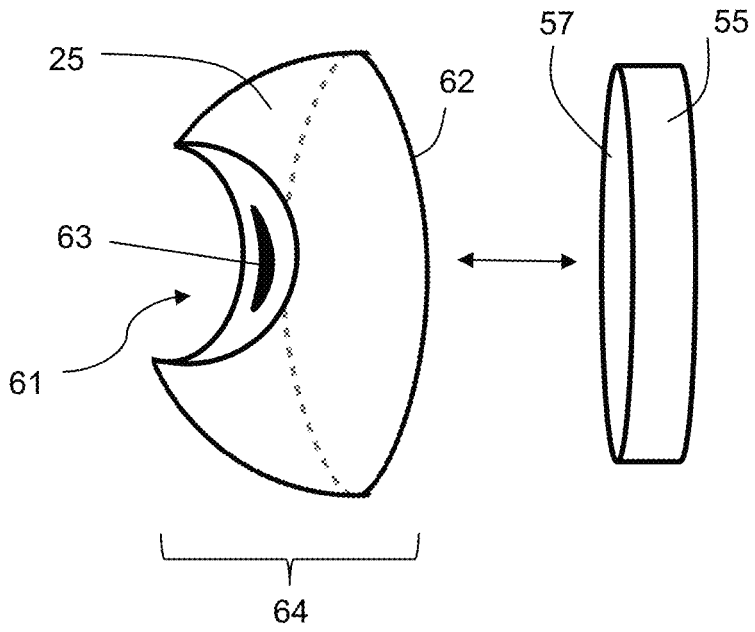
FIG. 6*b* is a perspective view of an apparatus joint configured to join with a spacer in accordance with some embodiments of the presently disclosed subject matter.

FIGS. 6*a* and 6*b* illustrates one embodiment of joint 25 that includes top face 60 comprising channel 61 that is sized and shaped to cooperate with collapsible rack 30. The channel can pass through the central portion of joint top face 60, although it can be positioned at any location (e.g., offset from the center). The joint further includes opposed rear face 62 that permanently or releasably attaches to front face 57 of the spacer using any desired mechanism (e.g., screws, bolts, fasteners, and the like). For example, the joint can include central aperture 63 that allows the joint to attach to a support (e.g., spacer 56) using a screw or bolt.

The joint can have any desired thickness 64 (e.g., the longest straight-line distance from front face 60 to rear face 62). For example, thickness 64 can be about 0.1-3 inches (e.g., at least/no more than about 0.1, 0.25, 0.5, 0.75, 1, 1.25, 1.5, 1.75, 2, 2.25, 2.5, 2.75, or 3 inches). However, thickness 64 is not limited to the range given herein.

Joint 25 is configured to rotate relative to spacer 56, such as during the extension and storage of rack 30, as described in detail herein below.

Spacer 55 and joint 25 can have any cross-sectional shape, such as circular, oval, square, rectangular, triangular, octagonal, pentagonal, hexagonal, and the like. In some embodiments, the spacer and joint have about the same shape and/or size. In other embodiments, the spacer can differ from the joint relative to shape and/or size.

Figure 7A:
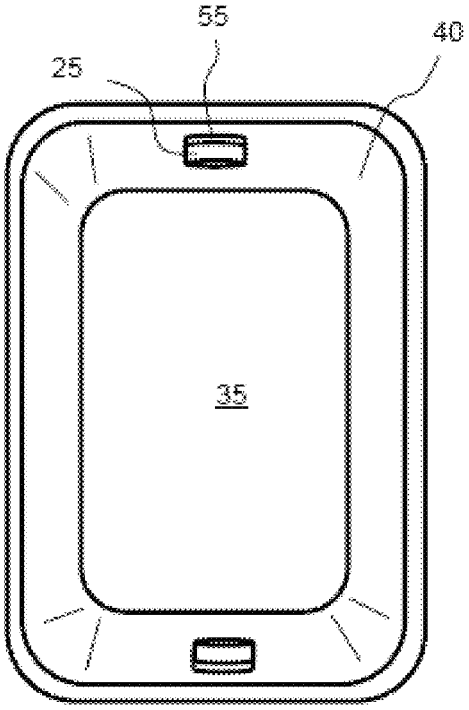
FIGS. 7*a* and 7*b* are top plan views of apparatus receptacles comprising a series of spacers and joints in accordance with some embodiments of the presently disclosed subject matter.
Figure 7B:
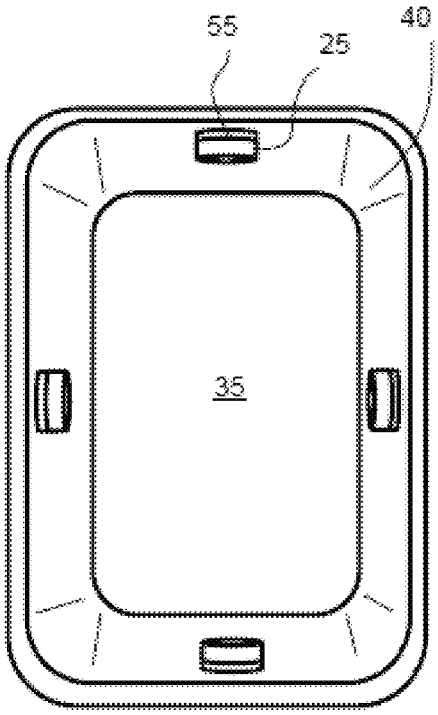

In some embodiments, the spacers and joints are positioned on opposing interior sidewall faces of receptacle 10, as shown in FIGS. 7*a* and 7*b*. Joints 55 and spacers 56 can be positioned at any location along sidewalls 40. For example, the joints and spacers can be positioned about 0.25-5 inches from lip 41 (e.g., at least/no more than about 0.25, 0.5, 0.75, 1, 1.25, 1.5, 1.75, 2, 2.25, 2.5, 2.75, 3, 3.25, 3.5, 3.75, 4, 4.25, 4.5, 4.75, or 5 inches). Thus, the joints and spacers can be positioned adjacent or near to the top edge of the receptacle.

It should be appreciated that in some embodiments, spacer 55 is optional and joint 55 can directly attach to the interior surface of sidewall 40. In these embodiments, the joint can rotate relative to the sidewall, and is configured with a thickness to allow the rack to extend and compress as needed for use and storage.

Figure 8A:
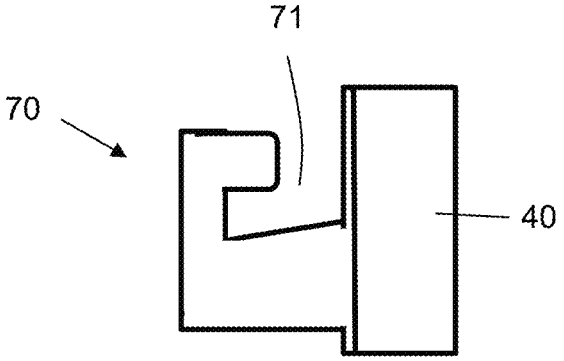
FIG. 8*a* is a side plan view of an apparatus clip in accordance with some embodiments of the presently disclosed subject matter.
Figure 8B:
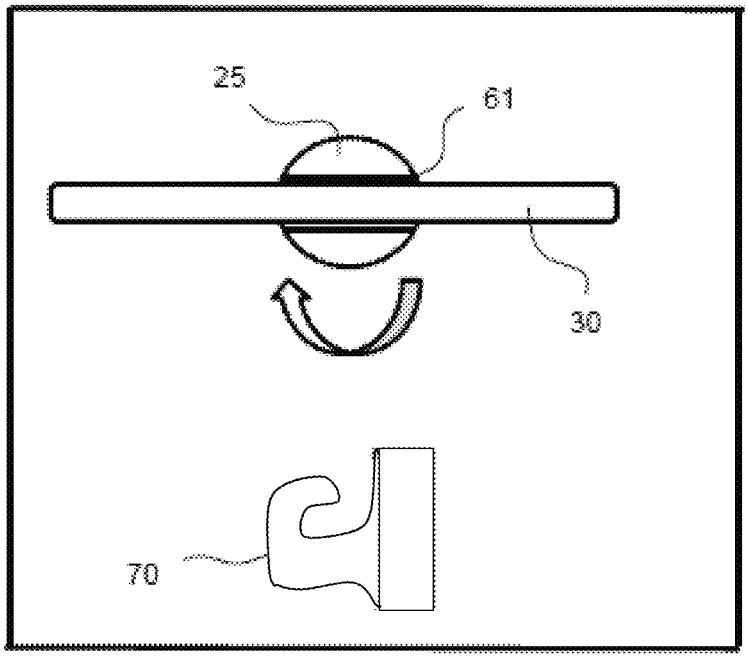
FIG. 8*b* is a front plan view of a joint and rack in a stored configuration in accordance with some embodiments of the presently disclosed subject matter.
Figure 8C:
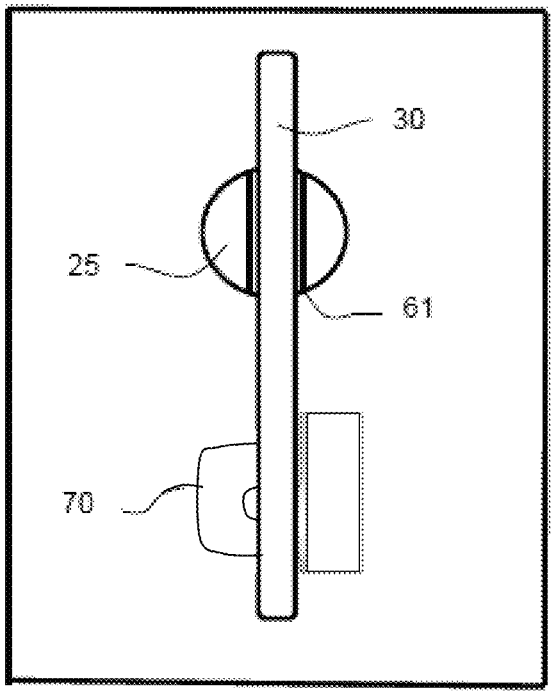
FIG. 8*c* is a front plan view of a joint, rack, and clip in a use configuration in accordance with some embodiments of the presently disclosed subject matter.

To maintain stability of rack 30, the sidewall interior faces can further include one or more clips 70 positioned above or below joint 25. The term "clip" refers to any element that allows for releasable connection with the rack. Each clip includes channel 71 sized and shaped to accommodate the rack in an extended orientation, as shown in FIG. 8*a*. In this way, when the rack is extended, it is maintained in the extended position and does not easily or inadvertently bend or collapse. When in the folded position, the rack can be removed from the clip channel, allowing it to fold away. Thus, the clip can have any desired configuration that includes a channel to cooperate with rack 30. In the storage configuration, when rack 30 is in an approximately horizontal and collapsed configuration, the clip is not in use, as shown in FIG. 8*b*. In such embodiments, the rack can optionally used as a handle to lift and/or position the receptacle as needed. However, in the use configuration, the joint is rotated, allowing the rack to be configured in an approximately vertical configuration, such that one portion of the rack is releasably held or stabilized by clip 70, as shown in FIG. 8*c*.

Clip 70 can be attached to sidewall 40 using any standard mechanism, such as (but not limited to) the use of adhesives, welding, magnets, mechanical elements (e.g., screws, bolts, clips, fasteners), or combinations thereof.

Figure 9A:
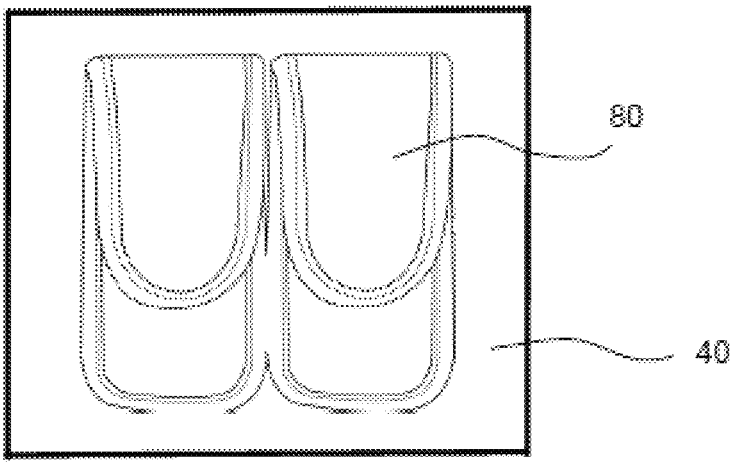
FIG. 9*a* is a front plan view of a receptacle storage pouch in accordance with some embodiments of the presently disclosed subject matter.
Figure 9B:
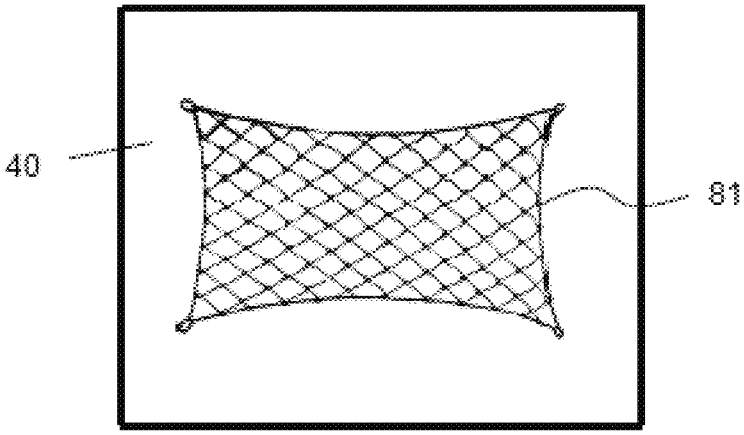
FIG. 9*b* is a front plan view of receptacle netting in accordance with some embodiments of the presently disclosed subject matter.
Figure 9C:
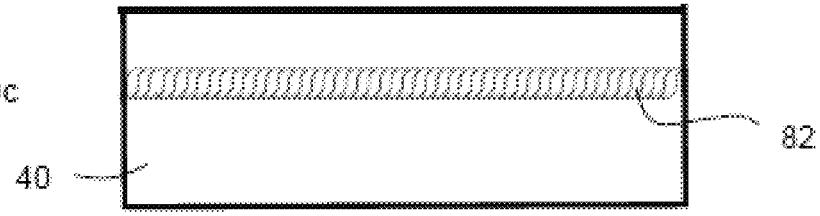
FIG. 9*c* is a front plan view of receptacle cordage in accordance with some embodiments of the presently disclosed subject matter.

The interior surface of sidewalls 40 can further include one or more storage elements that allow a user to store their personal belongings safely and securely. For example, the interior surface of one or more sidewalls can include any combination of pouches 80, netting 81, and/or cordage 82 that allows a user to stow personal items, such as shoes, water bottles, sunscreen, gloves, keys, phones, clothing, and the like, as shown in FIGS. 9*a*-9*c*. The interior of the receptacle further includes a great deal of empty space that is conveniently used to store wet and dirty wetsuits prior to being hung and dried.

Apparatus 5 can optionally include one or more fans to assist the user in drying their wetsuits. The fans can be battery powered, solar powered, and the like. It should be appreciated that the inclusion of a fan is optional.

Figure 10:
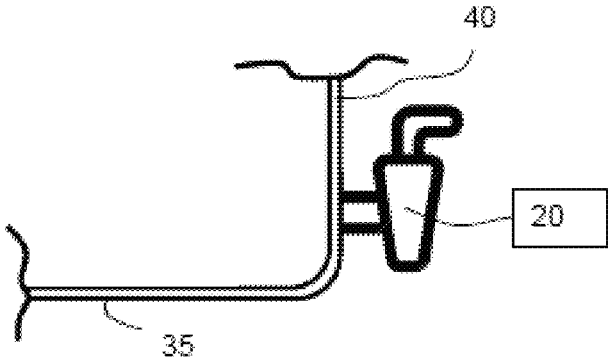
FIG. 10 a fragmentary side plan view of an apparatus drain in accordance with some embodiments of the presently disclosed subject matter.

As set forth above, receptacle 10 also includes drain 20 positioned adjacent to lower face 35. The term "drain" refers to any element that allows for the movement of fluid and/or debris from the interior of the receptacle to the exterior of the receptacle. In some embodiments, the drain is manual, such that the user can turn it on or off at any desired time. One embodiment of drain 20 is illustrated in FIG. 10. However, the structure of the drain is not limited, and any suitable type of drain can be used (e.g., one-way valve, check valve, solenoid valve, butterfly valve, spear valve, gate valve, diaphragm valve, glove valve, ball valve, and the like). When the drain is in the "open" position, liquid is permitted to flow from the receptacle interior to a location external to the apparatus. In the "closed" position, liquid is prevented from flowing from the receptacle interior.

In some embodiments, the drain is positioned on a sidewall about 0.1-2 inches from lower face 35 (e.g., at least/no more than about 0.1, 0.25, 0.5, 0.75, 1, 1.25, 1.5, 1.75, or 2 inches). However, the presently disclosed subject matter is not limited and drain 20 can be positioned at any desired location.

Figure 11:
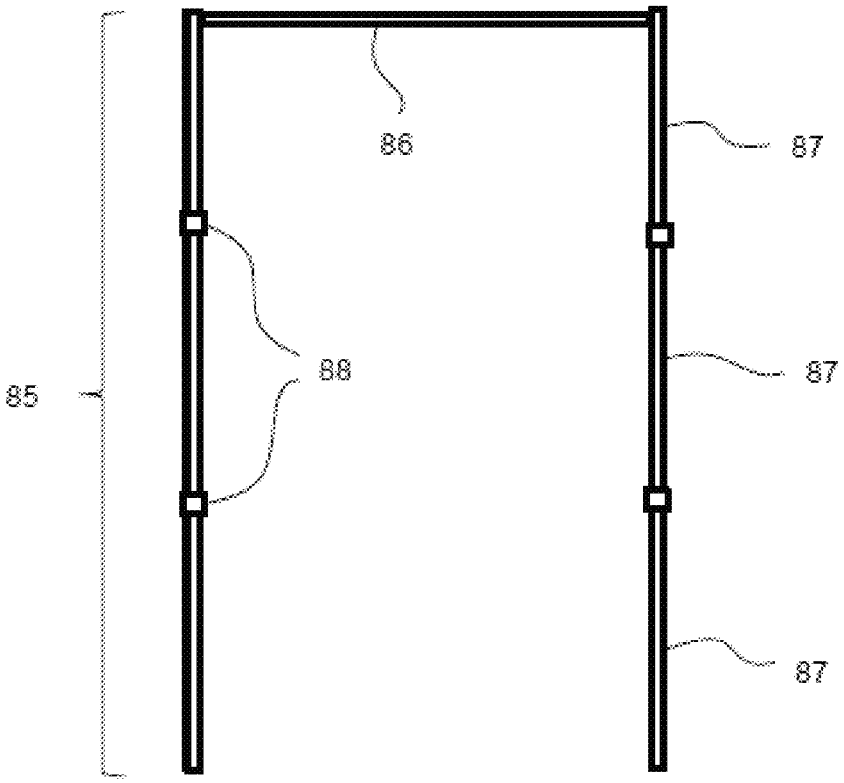
FIG. 11 is a front plan view of an apparatus rack in accordance with some embodiments of the presently disclosed subject matter.

The device also includes rack 30 that cooperates with the receptacle joint to hang and dry a wetsuit in an upright position, as shown in FIG. 11. The term "rack" refers to any extendable element that can support the weight of a wetsuit. In some embodiments, the rack can include a series of legs 85 connected to a central support 86. Each leg can include a plurality of segments 87 that allow the length of the legs to be adjusted as desired by the user. For example, each leg can be telescoping, include removable segments, or can include foldable segments. In some embodiments, each segment is connected to an adjacent segment via clamps 88. In this way, the length of the legs can be adjusted to accommodate articles of different sizes, such as adult wetsuits, children's wetsuits, towels, bathing suits, and the like.

Thus, rack can be constructed using a series of vertical bars (e.g., legs 85) and one or more horizontal bars (central support 86). Thus, the rack can be generally rectangular in shape, although any desired shape can be used.

Legs 85 and central support 86 can have any desired cross-sectional shape, such as circular, oval, square, triangular, and the like. Similarly, the legs and central support can have any desired diameter, such as about 0.25-2 inches (e.g., at least/no more than about 0.25, 0.5, 0.75, 1, 1.25, 1.5, 1.75, or 2 inches). However, the presently disclosed subject matter is not limited and the diameter of the legs and central support can have any desired dimensions.

Legs 85 can have any desired length, such as a compact length of about 12-30 inches, or a fully extended length of about 6 feet. However, it should be appreciated that the length of legs 85 can be varied and are not limited to the ranges given herein. Similarly, central support 86 can have any suitable length, such as (but not limited to) about 1-3 feet or more.

Legs 85 and central support 86 can be constructed from any rigid or semi-rigid material, such as (but not limited to) metal (e.g., stainless steel, aluminum), wood, plastic, rubber, ceramics, or combinations thereof. The materials selected should be sufficient to support the weight of items hung from the support, such as wetsuits.

In use, the disclosed assembly can be used to store a variety of products when rack 30 is in the folded position. For example, towels, wallets, phones, wetsuits, and clothing can be safely and securely housed within the interior of receptacle 10. Optionally, lid 41 can be secured on the top face of the receptacle to protect the items housed inside.

In some embodiments, the interior of the receptacle can be used to clean one or more items, such as a wetsuit. Wetsuits are exposed to salt water, sand, and other foreign objects and must be cleaned with fresh water after every use, or they begin to deteriorate and lose their thermal protection qualities. Moreover, sand and other foreign objects that have not been washed from the interior and exterior surfaces of the wetsuit can cause skin abrasions, irritation, and discomfort to the user. To wash an item (e.g., wetsuit), the user's personal belongings can optionally be removed from the interior of the receptacle or secured within an interior pouch or other waterproof container. The dirty wetsuit can then be added to receptacle interior 15, along with a sufficient amount of water, detergent, and the like to clean and/or rinse the wetsuit. The excess water remaining after washing or rinsing the wetsuit can be moved from the interior of the receptacle by opening drain 20 positioned adjacent to the bottom face of the receptacle.

Figure 12A:
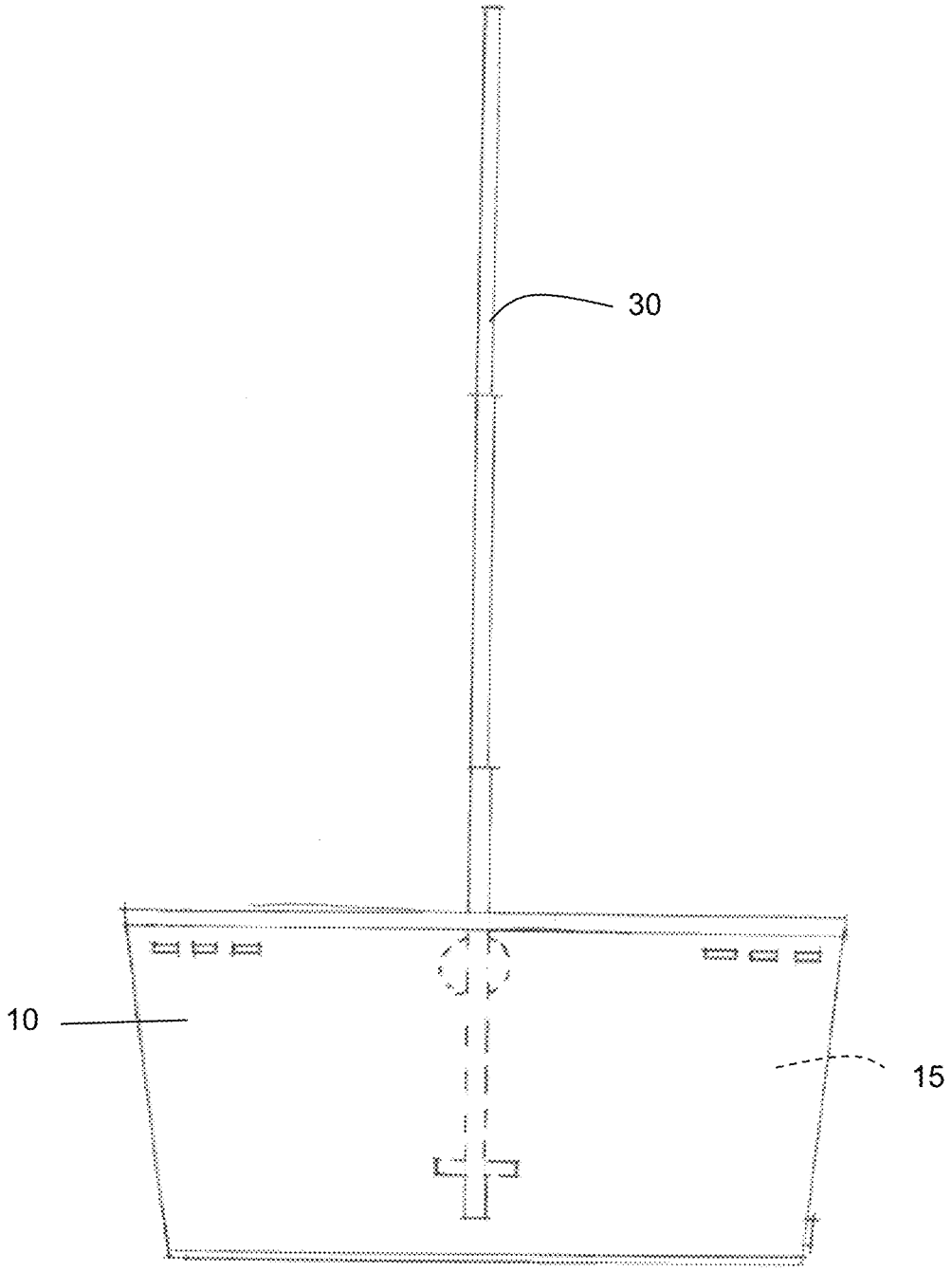
FIGS. 12*a*-12*d* are side plan views of the apparatus rack transitioning between storage and use configurations in accordance with some embodiments of the presently disclosed subject matter.
Figure 12B:
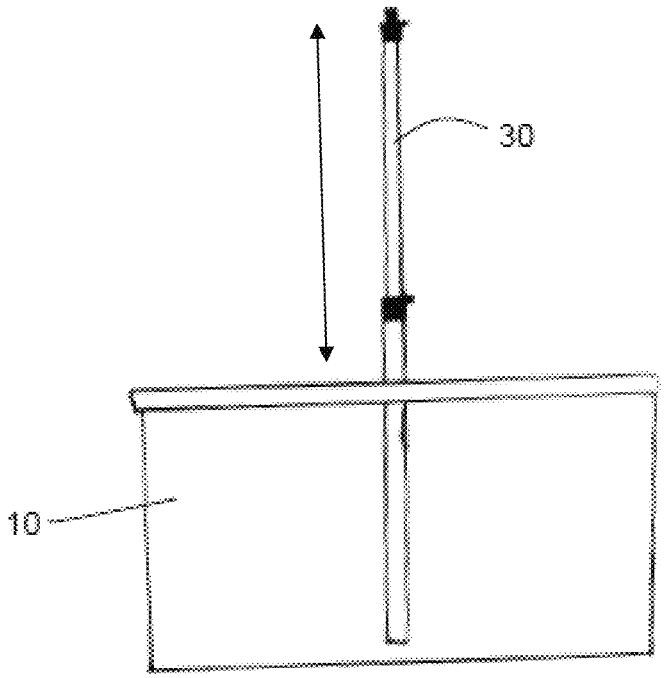
Figure 12C:
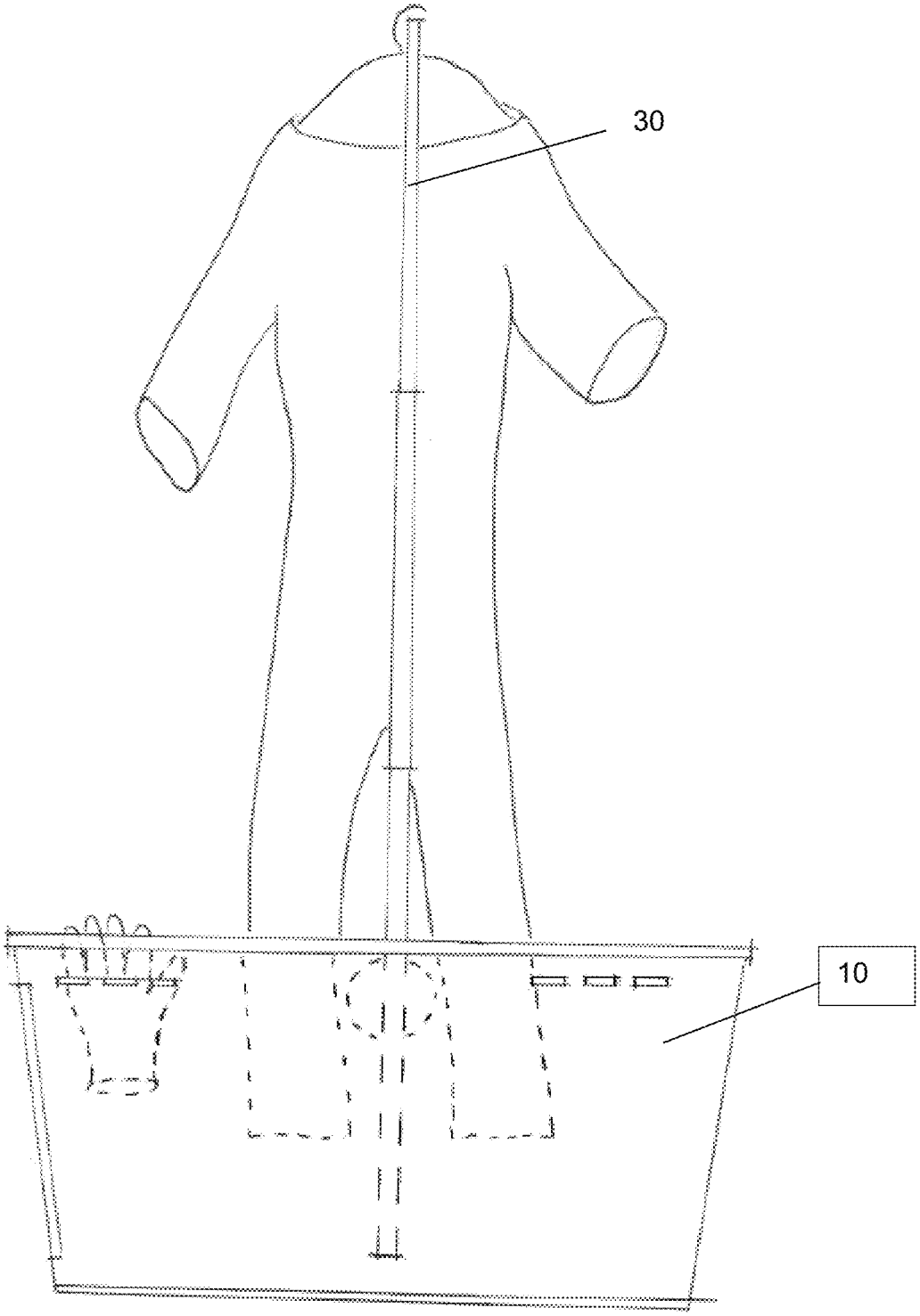
Figure 12D:
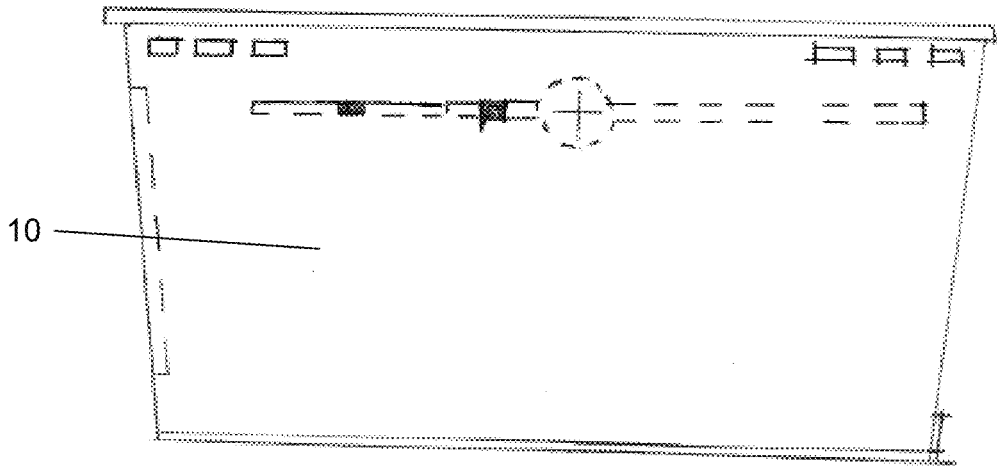

When a user desired to hang a wetsuit or other item from rack 30, the device can transition from a storage to use embodiment. Specifically, rack 30 can be adjusted from a relatively horizontal storage position within interior 15 (e.g., the legs and central support are positioned along the interior of the receptacle) and can be angled to an upright position via joint 25, as shown in FIGS. 12*d* and 12*a*. Once the rack legs are in an upright (e.g., approximately vertical position) on either side of the central support, the length of the legs can be adjusted as desired, as shown in FIG. 12*b*. For example, segments 87 can be extended in an upward direction with a length sufficient to allow a wetsuit, towel, bathing suit, etc. to hang from the central support (e.g., on a clothes hanger, clips, or any other desired hanging element), as illustrated in FIG. 12*c*. In some embodiments, the cleaned wetsuit does not touch adjacent items (e.g., other wetsuits, towels, and the like), as this can interfere with the cleaning and drying process.

Figure 13A:
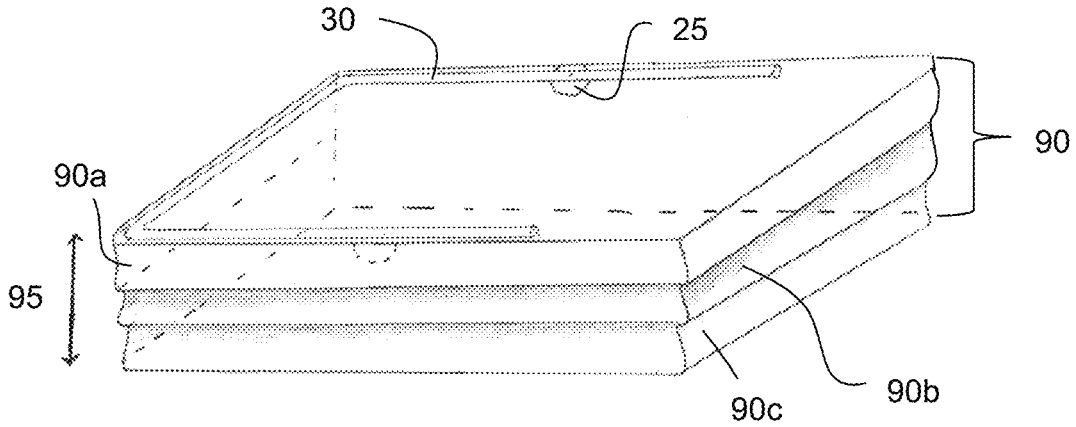
FIG. 13*a* is a perspective view of the apparatus with a flexible receptacle that can collapse and extend in accordance with some embodiments of the presently disclosed subject matter.
Figure 13B:
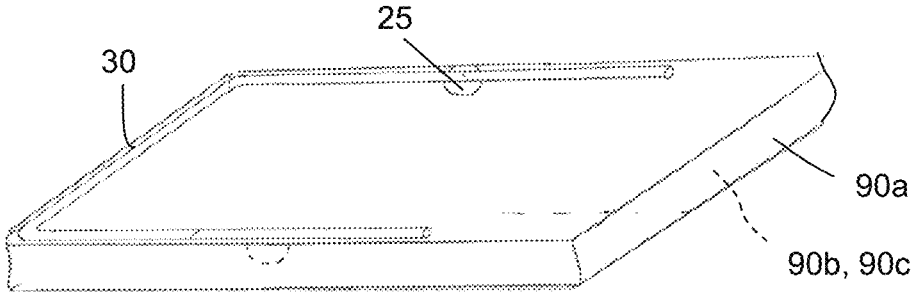
FIG. 13*b* is a perspective view of the apparatus of FIG. 13*a* in a collapsed configuration in accordance with some embodiments of the presently disclosed subject matter.

In some embodiments, the receptacle can include a series of connecting sections 90 that allow the receptacle to fold in an accordion-like fashion, as shown in FIG. 13*a*. Specifically, the receptacle sidewalls can include two or more connecting sections 90 that can be maintained in an upright or use position (such as shown in FIG. 12*d*). The sections can be constructed from any collapsible or flexible material such as (but not limited to) fabric. The sections can be extended or collapsed as indicated by arrow 95. Advantageously, the sections allow the receptacle to be collapsed completely, so that the sections are level with the bottom face of the receptacle. Top section 90*a* (level with the top of the receptacle) can have a circumference that is slightly greater than the adjacent section 90*b*, allowing the top section to fit slightly over the adjacent section. Similarly, section 90*b* has a circumference that is slightly greater than lower section 90*c*. In this way, the sections can collapse to the configuration of FIG. 13*b*.

Figure 14A:
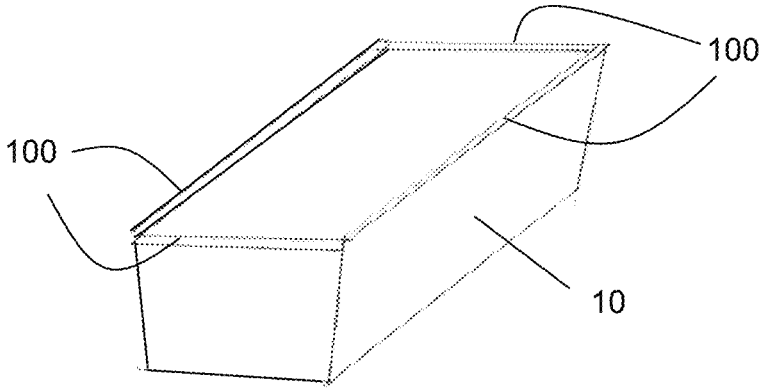
FIG. 14*a* is a perspective view of an apparatus in accordance with some embodiments of the presently disclosed subject matter.
Figure 14B:
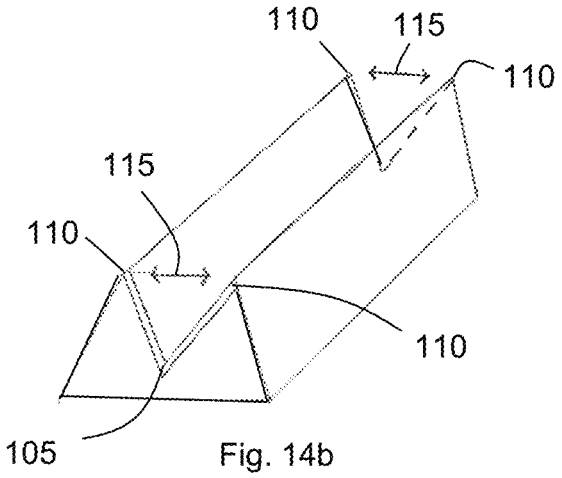
FIG. 14*b* is a perspective view of the apparatus of FIG. 14*a* in a partially folded orientation in accordance with some embodiments of the presently disclosed subject matter.
Figure 14C:
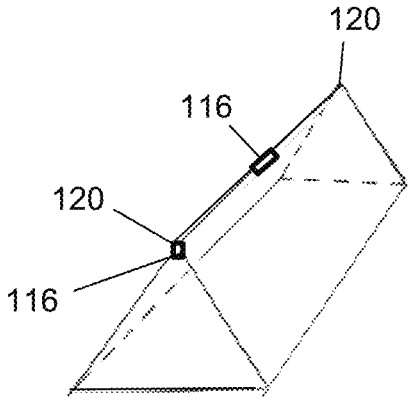
FIG. 14*c* is a perspective view of the apparatus of FIG. 14*a* in a fully folded orientation in accordance with some embodiments of the presently disclosed subject matter.

FIGS. 14*a*-14*c* illustrate an embodiment of the receptacle that can fold into an A-shaped collapsible structure. As shown in FIG. 14*a*, the top edge of the receptacle can include supports 100 that extend partially or fully around. The supports can be constructed from any rigid or semi-rigid material, such as wood, plastic, metal, and the like. A pair of opposing supports includes break 105 (which can be a joint or any element that allows the support to fold). Each break is configured to form a V-shape, as shown in FIG. 14*b* which can then be maneuvered into the A-frame collapsible shape illustrated in FIG. 14*c*. Specifically, After the break is advanced, the receptacle can be formed as an M-shaped structure with a pair of points 110 that can be advanced towards each other, as shown by arrows 115. The points can be retained together in some embodiments using closure 116 (e.g., magnets, clips, VELCRO®, fasteners, and the like) to form joined point 120. In this way, the receptacle has a small footprint and can be easily stored. The closures can be positioned at points 110, along the length of the supports, or both.

As the wetsuit dries, water runoff accumulates within the interior of the receptacle, pooling at the bottom surface. The water can be drained at any desired time by activating drain 20. For example, the receptacle can be transitioned to a bathtub or outside environment to drain the excess water from interior 15.

After the wetsuit has been dried, it can be removed from rack 30 and stored within the interior of the receptacle or any desired location (such as a closet) until it is needed again.

Rack legs 85 can then be retracted to the storage (i.e., collapsed) position within the interior of the receptacle, as shown in FIG. 12*d*. Any additional items can optionally be housed within interior 15 for secure storage.

The presently disclosed subject matter includes many advantages over prior art drying systems. Specifically, apparatus 5 allows a wetsuit (or any desired item) to be easily and efficiently dried without exposure to excessive temperatures or sunlight.

The disclosed apparatus is also easily transportable, allowing the user to store and/or dry multiple wetsuits and accessories at a single time.

Apparatus 5 is durable, and is constructed to withstand contact with sand, rain, salt water, and the like.

The disclosed apparatus advantageously provides the user with a vessel to both wash, dry, and store wetsuits and other similar articles.

Beneficially, the apparatus can keep the wetsuits and accessories in a single location.

The disclosed apparatus can extend the life of expensive wetsuits by facilitating proper care and cleaning of the items.

The optional pouches, netting, and cordage provides a convenient location to clamp or retain a variety of personal items, such as gloves, wetsuit boots, and the like for storage or drying purposes.

Drain 20 allows for easy and efficient drainage from the interior of the apparatus after a wetsuit has fully dried or has been washed within the interior.

The apparatus was designed to be stowed in a vehicle and to be readily available with all of one's equipment in one location. When the user finishes using their wetsuit, their vehicle is clean because they are able to store their wet and dirty equipment in the apparatus.

As described above, although a preferred embodiment of the present invention has been described for illustrative purposes, those skilled in the art will appreciate that various modifications, additions, and substitutions are possible, without departing from the scope and spirit of the invention as disclosed in the accompanying claims.

What is claimed is:

1. An apparatus for cleaning, drying, and storing a wetsuit, the apparatus comprising:

a receptacle defined by a lower face joined to a series of sidewalls, thereby creating an interior and an open top face;

a plurality of rotatable joints configured on an interior sidewall surface of the receptacle, wherein each joint comprises a central channel and the joint is rotatable from a first position where the central channel is horizontal to a second position where the central channel is vertical;

a rack defined by a pair of extendable legs, each leg comprising a first end and a second end, wherein the first end is joined to a central support and the second end cooperates within the joint channel to allow the rack position to be rotated;

a drain positioned adjacent to the lower face of the receptacle, configured to allow and stop the flow of fluid from the interior of the receptacle.

2. The apparatus of claim 1, wherein the top edge of the receptacle sidewalls includes a peripheral lip configured to releasably join with a lid.

3. The apparatus of claim 1, wherein the receptacle lower face is angled towards the drain.

4. The apparatus of claim 1, wherein the receptacle sidewalls are configured at an obtuse or acute angle relative to the lower face.

5. The apparatus of claim 1, wherein the receptacle lower face, sidewalls, or both are collapsible.

6. The apparatus of claim 1, wherein the receptacle interior further comprises a spacer positioned between a joint and a receptacle sidewall.

7. The apparatus of claim 6, wherein the spacer has a thickness of about 0.1-3 inches.

8. The apparatus of claim 1, wherein the joint is releasably positioned along the interior of the receptacle.

9. The apparatus of claim 1, wherein the joint is permanently positioned along the interior of the receptacle.

10. The apparatus of claim 1, wherein the receptacle comprises a pair of joints positioned on opposing surfaces of the receptacle sidewalls.

11. The apparatus of claim 1, further comprising a clip positioned adjacent to the joint on an interior surface of the receptacle, wherein the clip comprises a channel that is sized and shaped to releasably connect with the rack.

12. The apparatus of claim 1, wherein the receptacle interior further comprises one or more pouches, containers, netting, or cordage.

13. The apparatus of claim 1, wherein the receptacle comprises a series of supports that extend around a top edge of the receptacle, where at least two opposed supports include a break that folds the support into a V-shape and the sidewall adjacent to the V-shaped supports into an M-shape, and wherein each of the top points of the M is releasably attached, creating an A-shaped collapsible receptacle.

14. The apparatus of claim 1, wherein the sidewalls are divided into a series of horizontal sections, wherein each section has a circumference that is less than the section positioned directly above it, and a circumference that is greater than the section positioned directly below it, wherein the sidewall sections collapse to form a compressed shape, whereby the section adjacent to a top edge of the receptacle is visible, and the remaining sections are folded behind the section adjacent to the top edge of the receptacle.

15. The apparatus of claim 1, wherein each rack leg is telescoping, has removable segments, has foldable segments, or combinations thereof.

16. A method of cleaning and drying a wetsuit, the method comprising:

washing a wetsuit within the interior of the apparatus of claim 1 by positioning the wetsuit within the receptacle interior;

rotating the receptacle joint from the first horizontal position to the second vertical position;

extending the legs of the apparatus to a desired length;

suspending the washed wetsuit in an upright position on the support bar of the rack to dry;

whereby any liquid runoff from the wetsuit is contained within the receptacle interior.

17. The method of claim 16, further comprising storing the cleaned and dried wetsuit within the interior of the apparatus receptacle.

18. The method of claim 16, further comprising activating the drain to remove the liquid from the interior of the receptacle.

19. The method of claim 16, further comprising positioning the legs in a clip positioned on the interior surface of the receptacle after the legs are extended.

20. The method of claim 16, wherein one or more fans facilitate drying of the wetsuit.

* * * * *